United States Patent [19]

Weber et al.

[11] Patent Number: 4,458,594

[45] Date of Patent: Jul. 10, 1984

[54] FUSE WITH A DETONATOR

[75] Inventors: Adolf Weber, Neunkirchen; Siegfried Rhau, Nuremberg; Hans Strauss, Reichenschwang; Utz-Udo Ahlers, Diepersdorf, all of Fed. Rep. of Germany

[73] Assignee: Diehl GmbH and Co., Nuremberg, Fed. Rep. of Germany

[21] Appl. No.: 334,216

[22] Filed: Dec. 24, 1981

[30] Foreign Application Priority Data

Dec. 24, 1980 [DE] Fed. Rep. of Germany ..... 3049082

[51] Int. Cl.[3] ..... F42C 15/04; F42C 15/26; F42C 15/34

[52] U.S. Cl. ..... 102/240; 102/235; 102/245

[58] Field of Search ..... 102/231, 232, 235, 236, 102/237–241, 243–246

[56] References Cited

U.S. PATENT DOCUMENTS

| | | | |
|---|---|---|---|
| 2,495,431 | 1/1950 | Thompson | 102/246 |
| 2,626,568 | 1/1953 | Podnos et al. | 102/245 |
| 2,707,918 | 5/1955 | Clay | 102/245 |
| 3,397,640 | 8/1968 | Ziemba et al. | 102/243 |
| 3,500,748 | 3/1970 | Hager et al. | 102/245 X |
| 3,608,494 | 9/1971 | Ziemba | 102/235 |
| 3,871,297 | 3/1975 | Bayard et al. | 102/245 |
| 3,954,061 | 5/1976 | Rudenauer et al. | 102/240 X |
| 3,994,230 | 11/1976 | Kalin | 102/240 X |
| 3,995,557 | 12/1976 | Engel et al. | 102/240 X |

*Primary Examiner*—David H. Brown

*Attorney, Agent, or Firm*—Scully, Scott, Murphy and Presser

[57] ABSTRACT

In small-caliber, barreled-weapon ammunition with head or base fuses, detonator safety is achieved in that the inadvertantly ignited detonator which is a secure position within a rotor remains without effect on an intensifying charge. Measures are provided for the gas to expand within the fuse and the energy of the rotor fragments used up so that the gas expanding direction and the flight direction of the fragments face away from the explosives of the intensifying charge. Expansion chambers are formed by recesses in the fuse for safety devices adjacent the rotor, such as different centrifugal force-dependent safety devices for the firing pin which are separated from each other by breaking locations destroyable by the gas.

4 Claims, 2 Drawing Figures

FUSE WITH A DETONATOR

BACKGROUND OF THE INVENTION

1. Field of the Invention

The present invention relates to a fuse with a detonator, which is seated within a rotor, a firing pin, safety devices and an intensifying charge.

2. Discussion of the Prior Art

A fuse of that type has become known from U.S. Pat. No. 2,790,390. As is known, fuses which include an explosive charge as the intensifying charge require that the detonator be located externally of the effective direction of the firing pin in order to prevent that the fuse will be triggered upon an inadvertent actuation of the firing pin. Nevertheless, there can be encountered an ignition of the detonator, for example, through shock or the effect of heat. The result will then be that the detonator will rupture the fuse housing and ignite the intensifying charge. Consequently, there can be occasioned extensive damage to the weapon and in the magazine.

SUMMARY OF THE INVENTION

Accordingly, it is an object of the present invention to so provide for detonator safety for small caliber barreled-weapon ammunition that the intensifying charge will not be ignited, not will there be encountered any damage to the external components of the fuse.

The foregoing object is achieved through the intermediary of the present invention in that, for an inadvertent ignition, the rotor which has been pivoted into a position of safety so that the gas pressure, as well as the fragments of the ruptured rotor will escape only in the direction of the firing pin into at least one adjoining or adjacent expansion chamber.

Advantageous hereby is that the foregoing object can be achieved with relatively low constructive requirements in which no additional components are necessary. Merely currently existing components need to be constructively modified.

With regard to the foregoing, there is also afforded that during ignition of the detonator when the rotor is in the safety position, the latter is supported so along its surface that on the side of the rotor no fragments will be formed which would be capable of igniting the intensifying charge.

BRIEF DESCRIPTION OF THE DRAWINGS

Reference may now be had to the following detailed description of exemplary embodiments of the invention, taken in conjunction with the accompanying drawings; in which.

DETAILED DESCRIPTION

Figure 1:
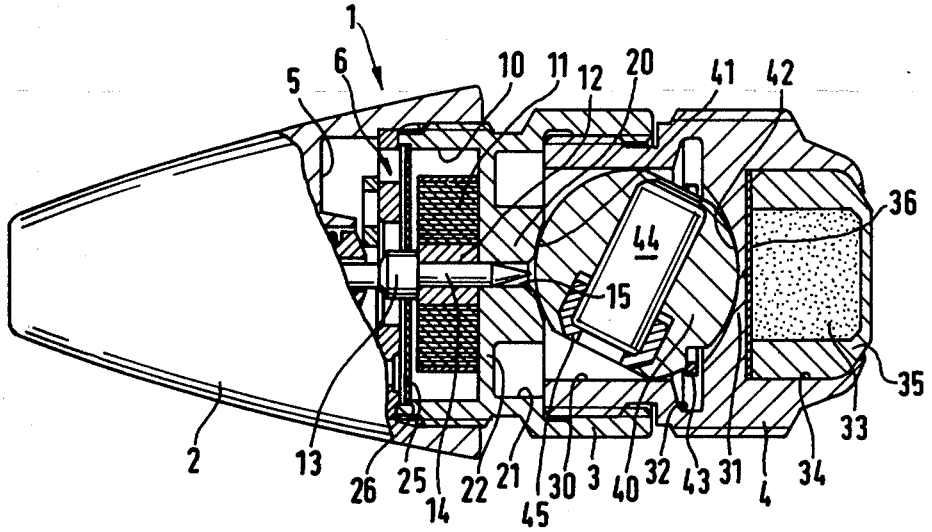
FIG. 1 illustrates a nose percussion fuse.

According to FIG. 1 the fuse 1 consists of the following sections: head 2, shank 3, and base 4. Arranged within the head 2 is a centrifugal force-actuated safety device 6, not described in detail herein, which includes an expansion chamber 5.

The shank 3 supports within an expansion chamber 10 a coiled sheet-steel spring with a radially expandable core sleeve 12. Supported on the core sleeve 12 is the head 13 of a firing pin 14. The firing pin 14 is guided within the bore 15 of an intermediate partition 20. Formed in the intermediate partition 20, through an annular recess 21, is a breaking location 22. A plate 25 is positioned against the head 13 and against a shoulder 26.

Provided in the base 4 is a recess 30 with a spherically dished bottom 31 and an undercut 32, as well as a bore 34 which receives the intensifying charge 33. The intensifying charge 33 is pressed into a cup 35 and sealed off by a foil 36. The cup 35 is flanged into the base 4.

Figure 2:
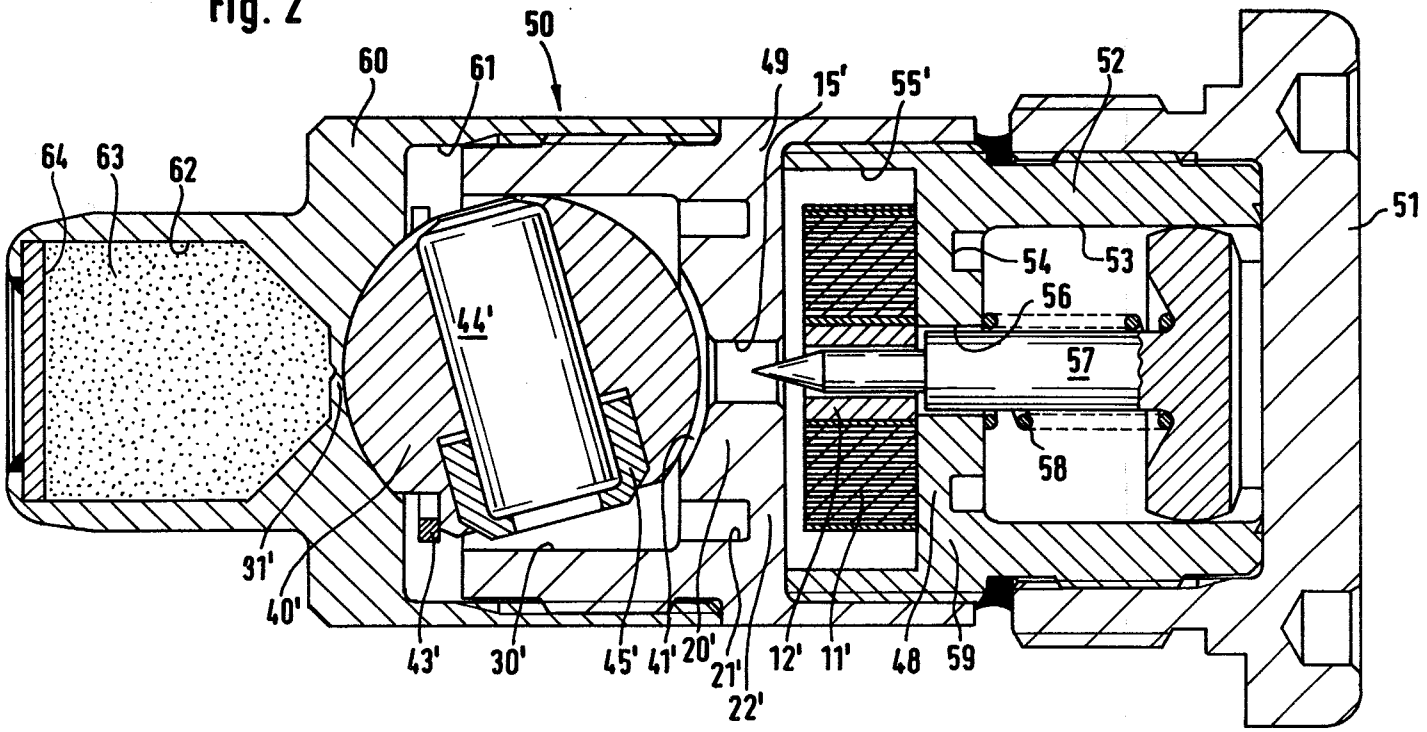
FIG. 2 illustrates a base percussion fuse.

Pivotably supported within the recess 34, in a known manner, is a spherically-shaped rotor 40, which has a large surface portion contacting the cup surface 42. A gap 41 is formed between the rotor 40 and the intermediate partition 20, as is also shown in FIG. 2. The illustrated safety position of the rotor 40 is afforded by an expandable spring 43 acting under centrifugal force within the undercut 32. The rotor 40 contains a flanged-in detonator 44 with an apertured cap 45.

The manner of operation of the described arrangement consists of in that upon the inadvertent detonation of the detonator 44, the gas impact will initially expand within the breaking location 22 so as to enter into the space 10. Therein the plate 25 will be destroyed so that the gas will then enter in to the chamber 5. Due to the stepwise expansive capability of the gas, the pressure of the gas impact is reduced in a calculated manner, without destroying the components of the fuse, in essence, head 2, and the parts within the projectile which is not illustrated, in essence, the shank 3 and base 4. Immediately thereafter the rotor 40 is disintegrated by the gas impact, wherein the portion of the rotor facing towards the base (cup 35) is supported over a large surface on the base 4. The fragments of the rotor 40 penetrate hereby into the spaces 5 and 10, wherein there is absorbed the energy of the fragments. In particular, across the bottom 31 no impulse is transmitted which would be relevant for the ignition of the intensifying charge 33, in effect the bottom 31 is not ripped open.

According to FIG. 2, the components which have already been described with respect to FIG. 1, are provided with similar designations but with the suffix "prime" (′). The base fuse 50 includes the following components: sleeve screw 51, sleeve 52 with recesses 53 to 55, bore 56, firing pin 57 with spring 58, and coiled sheet-steel spring 11′ with core sleeve 12′, shank 49 with recesses 21′ and 30′, gap 41′, rotor 40′ with detonator 44′ and spring 43′, and breaking location 22′ and base 60 with recesses 61 and 62, and flanged-in intensifying charge 63 and plate 64.

The effectiveness of the detonator 44′ which is in the secured position consists of in that the gas which is generated by the detonator 44 flows into the recesses 21, 30, tears open the breaking location 22′, flows into the recess 55 in order to then destroy the annular breaking location 48 of the intermediate partition 59, so that the gas will flow into the recess 53. Ensured thereby is an expansion of the gas without ignition of the intensifying charge 63 and without tearing open of the base fuse in an axial or radial direction. Moreover, analogous to the embodiment with respect to FIG. 1, there cannot be formed any rotor fragments which would be relevant for the ignition of the intensifying charge 53.

The invention is not limited to fuses for small-caliber barreled-weapon ammunition. It can be generally used wherein there is required the described detonation safety.

We claim:

1. Fuse including a detonator; a rotor pivotable between secure and armed positions, said rotor having said detonator seated therein; including a firing pin, safety means and an intensifying charge; and at least one expansion chamber having a pre-weakened partition wall adjoining said rotor, inadvertent ignition of the detonator when said rotor is in the secure position, causing the generated during ignition to rupture said partition wall and disintegrating said rotor whereby the fragments of the disintegrated rotor will escape only in the direction of said firing pin into said expansion chamber towards the tip of the fuse.

2. Fuse as claimed in claim 1, said rotor having a surface containing the fuse base in the region of said intensifying charge.

3. Fuse as claimed in claim 1, comprising recesses facing said firing pin forming said expansion chambers; and further safety means and said firing pin being arranged in said recesses.

4. Fuse as claimed in claim 3, comprising breaking locations being located intermediate the space receiving said rotor and the recesses.

* * * * *